US006075405A

United States Patent [19]

Nishino et al.

[11] Patent Number: 6,075,405

[45] Date of Patent: Jun. 13, 2000

[54] CONSTANT CURRENT CIRCUIT

[75] Inventors: Akira Nishino; Nobuo Kobayashi, both of Tokyo, Japan

[73] Assignee: Oki Electric Industry Co., Ltd., Tokyo, Japan

[21] Appl. No.: 09/092,875

[22] Filed: Jun. 8, 1998

[30] Foreign Application Priority Data

Jun. 25, 1997 [JP] Japan ..... 9-168213

[51] Int. Cl.[7] ..... G05F 1/10

[52] U.S. Cl. ..... 327/538; 327/543; 323/312; 323/315

[58] Field of Search ..... 327/538, 543; 330/288; 323/312, 315

[56] References Cited

U.S. PATENT DOCUMENTS

| | | | |
|---|---|---|---|
| 5,440,224 | 8/1995 | Kimura | 323/313 |
| 5,654,665 | 8/1997 | Menon et al. | 327/541 |
| 5,670,868 | 9/1997 | Moriguvhi et al. | 323/313 |
| 5,818,212 | 10/1998 | Min et al. | 323/314 |

OTHER PUBLICATIONS

"Implementation of GaAs E/D HEMT Analog Components for Oversampling Analog/Digital Conversion", *IEEE GaAs IC Symposium, 1994, U.S.A.*, Shen Feng, Josef Sauerer and Dieter Seizer, p. 228–231.

*Primary Examiner*—Timothy P. Callahan
*Assistant Examiner*—Hai L. Nguyen
*Attorney, Agent, or Firm*—Rabin & Champagne, P.C.

[57] ABSTRACT

A constant current circuit including a first field effect transistor having a drain connected to an output terminal and having a source connected to a first power supply via a first resistor, and a plurality of field effect transistors, of each of which the ordinal number is 1 through N, and of each of which the source and the drain are connected to each other, and each of which is connected in series to one another to form a series circuit of field effect transistors, a drain of a field effect transistor located at an end of the series circuit of field effect transistors being connected to a second power supply via a second resistor, a drain of one field effect transistor composing the series circuit of field effect transistors being connected to a gate of said first field effect transistor, and an opposite end of the series circuit of field effect transistors being connected the first power supply terminal.

3 Claims, 3 Drawing Sheets

CONSTANT CURRENT CIRCUIT

FIELD OF THE INVENTION

This invention relates to a constant current circuit composed of a field effect transistor. More specifically, this invention relates to a constant current circuit which can prevent variation of the output current from occurring, even in the cases where the threshold voltage of the field effect transistor deviates due to the dispersion in a production process or in the cases where the temperature at which the constant current circuit is employed, varies.

This type of constant current circuit is disclosed in a literature entitled Technical Digest of IEEE GaAs IC Symposium, 1994, U.S.A., Shen Feng, Josef Sauerer, Dieter Seitzer, "Implementation of GaAs E/D HEMT Analog Components for Oversampling Analog/Digital Conversion" P.228–231. FIG. 1 is a circuit diagram of a differential amplifier employing a constant current circuit available in the prior art and which is disclosed in the foregoing literature. The differential amplifier circuit has a positive phase signal input terminal 1 which receives an input voltage $V_{i1}$, an opposite phase signal input terminal 2 which receives an input voltage $V_{i2}$, a positive phase signal output terminal 3 which outputs an output bias voltage $V_{o1}$, an opposite phase signal output terminal 4 which outputs an output bias voltage $V_{o2}$ and a power supply terminal 5 which receives a power supply voltage VD. The gates of a field effect transistor 11 and of a field effect transistor 12 are respectively connected the input terminal 1 and the input terminal 2. The drain of the field effect transistor 11 is connected to the output terminal 4 and to the power supply terminal 5 via a load resistor 13. The drain of the field effect transistor 12 is connected to the output terminal 3 and to the power supply terminal 5 via a resistor 14. The sources of the field effect transistor 11 and of the field effect transistor 12 are connected commonly to the drain of a field effect transistor 15 composing a constant current circuit. The source and the gate of the field effect transistor 15 are commonly connected to the ground terminal at which the ground potential G is applied.

In the foregoing differential amplifier, the field effect transistors 11 and 12 are turned ON and OFF by applications of the input voltages $V_{i1}$ and $V_{i2}$ inputted at the input terminals 1 and 2. The drain current i flowing in the field effect transistor 15 composing the constant current circuit flows into the field effect transistors 11 and 12 via the sources thereof. Output bias voltages $V_{o1}$ and $V_{o2}$ which correspond to the input voltage $V_{i2}$ and $V_{i1}$ are outputted from the output terminals 3 and 4.

The output bias voltages $V_{o1}$ and $V_{o2}$ which are outputted from the output terminals 3 and 4 correspond to a situation in which the drain current i of the field effect transistor 15 composing the constant current circuit is divided equally in the field effect transistor 11 and in the field effect transistor 12. As a result, if the resistance of the load resistors 13 and 14 is supposed to be $r_1$, a formula $V_{o1}=V_{o2}=VD-(i\cdot r)/2$ comes true. In addition, the maximum output amplitude of the output voltage outputted at the output terminals 3 and 4 turns out to be $i\cdot r$.

The constant current circuit employed in the foregoing differential amplifier is involved with four drawbacks tabulated below.

1. Dispersion or unevenness is inevitable to some extent for the threshold voltage of a field effect transistor produced employing a prior art. If the threshold voltage of a field effect transistor 15 deviates beyond a certain extent, the current i flowing in the field effect transistor 15 turns out to deviate from the designed value, resultantly causing the output bias voltage of the foregoing differential amplifier of the prior art, deviates accordingly corresponding to the deviation of the current i flowing in the field effect transistor 15. As a result, the characteristics of the foregoing differential amplifier of the prior art is devastated.
2. If the threshold voltage of a field effect transistor 15 deviates beyond a certain extent, the current i flowing in the field effect transistor 15 turns out to deviate from the designed value, resultantly causing the maximum output amplitude of the foregoing differential amplifier of the prior art, to deviate accordingly corresponding to the deviation of the current i flowing in the field effect transistor 15.
3. If the temperature under which the foregoing differential amplifier of the prior art is employed, varies, the drain current i flowing in a field effect transistor 15 employed in the foregoing differential amplifier of the prior art turns out to vary, resultantly deviating the output bias voltage of the differential amplifier accordingly corresponding to the deviation of the drain current i flowing in a field effect transistor 15. As a result, the characteristics of the foregoing differential amplifier of the prior art is devastated.
4. If the temperature under which the foregoing differential amplifier of the prior art is employed, varies, the drain current i flowing in a field effect transistor 15 employed in the foregoing differential amplifier of the prior art turns out to vary, resultantly deviating the maximum output amplitude of the foregoing differential amplifier of the prior art to deviate accordingly corresponding to the deviation of the drain current i flowing in a field effect transistor 15.

OBJECTS AND SUMMARY OF THE INVENTION

Accordingly, the object of this invention is to provide a constant current circuit of which the output current is stable, even in the case where the threshold voltage of a field effect transistor employed therein, deviates from the designed value due to dispersion or unevenness in the production process thereof and/or in the case where the temperature under which the constant current circuit is employed varies.

To achieve the foregoing objects, a constant current circuit in accordance with a first embodiment of this invention comprises:

a first field effect transistor having a drain connected to an output terminal and having a source connected to a first power supply via a first resistor, and a second field effect transistor having a drain connected to a gate of the first field effect transistor and to a second power supply via a second resistor and having a source and a gate connected to the first power supply.

In the foregoing constant current circuit, the first and second field effect transistors can be of n-channel enhancement type, n-channel depletion type, p-channel enhancement type or p-channel depletion type as long as the first and second field effect transistors are of the same type, the potential of the power supplies are properly selected and the drains and the sources of the field effect transistors are properly allotted.

If the drain current flowing in the first field effect transistor decreases due to deviation of the threshold voltage of the first field effect transistor caused by dispersion or unevenness in the production process thereof or due to variation of temperature in which the constant current circuit is employed, the current flowing in the second resistor decreases. This causes an increase of the gate-source voltage and results in an increase of the drain current flowing in the first field effect transistor. Conversely, if the drain current flowing in the first field effect transistor increases due to the same reasons as were described above, the current flowing in the second resistor increases. This causes a decrease of the gate-source voltage and results in a decrease of the drain current flowing in the first field effect transistor. In this manner, deviation of the output current is successfully compensated in the constant current circuit of the first embodiment of this invention.

To achieve the foregoing objects, a constant current circuit in accordance with a second embodiment of this invention comprises:

a first field effect transistor having a drain connected to an output terminal and having a source connected to a first power supply via a first resistor, and a plurality of field effect transistors of which the ordinal number are 1 through N and of each of which the source and the drain are connected to each other and each of which is connected in series to one another to form a series circuit of field effect transistors, a drain of a field effect transistor located at an end of the series circuit of field effect transistors being connected to a second power supply via a second resistor, a drain of one field effect transistor composing the series circuit of field effect transistors being connected to a gate of the first field effect transistor, and an opposite end of the series circuit of field effect transistors being connected the first power supply terminal.

In the foregoing constant current circuit, all the field effect transistors can be of n-channel enhancement type, n-channel depletion type, p-channel enhancement type or p-channel depletion type as long as all the field effect transistors are of the same type, the potential of the power supplies are properly selected and the drains and the sources of the field effect transistors are properly allotted.

A modification can be delived from the foregoing constant current circuit in accordance with the second embodiment of this invention. In the modification, a drain-source voltage of each field effect transistor composing the series circuit of field effect transistors is selected to be identical to or more than the minimum saturation voltage of the field effect transistor and less than a dielectric strength of the field effect transistor and the quantity of the plural field effect transistors composing the series circuit of field effect transistors is selected to make the potential of the second power supply identical to the potential of the power supply of an external circuit for which the constant current power supply circuit is employed.

If the drain current flowing in the first field effect transistor decreases due to deviation of the threshold voltage of the first field effect transistor caused by dispersion or unevenness in the production process thereof or due to variation of temperature in which the constant current circuit is employed, the current flowing in the second resistor decreases. This causes an increase of the gate-source voltage and results in an increase of the drain current flowing in the first field effect transistor. Conversely, if the drain current flowing in the first field effect transistor increases due to the same reasons as was described above, the current flowing in the second resistor increases. This causes a decrease of the gate-source voltage and results in a decrease of the drain current flowing in the first field effect transistor. In this manner, deviation of the output current is successfully compensated in the constant current circuit of the first embodiment of this invention.

The results of this invention is remarkable for any of the foregoing constant current circuits, when all the field effect transistors are selected from a group produced in one same production lot or produced on a single semiconductor chip. In the latter case, the entire circuit of the constant current circuit can be preferably produced on a single semiconductor chip to enhance the results of this invention. In this case, any accompanying circuit e.g. a differential circuit described above can be produced on the single semiconductor chip on which the corresponding constant circuit is produced, to enhance the results of this invention.

BRIEF DESCRIPTION OF THE DRAWINGS

This invention, together with its various features and advantages, can be readily understood from the following more detailed description presented in conjunction with the following drawings, in which.

DETAILED DESCRIPTION OF THE PREFERRED EMBODIMENTS

FIRST EMBODIMENT

Figure 1:
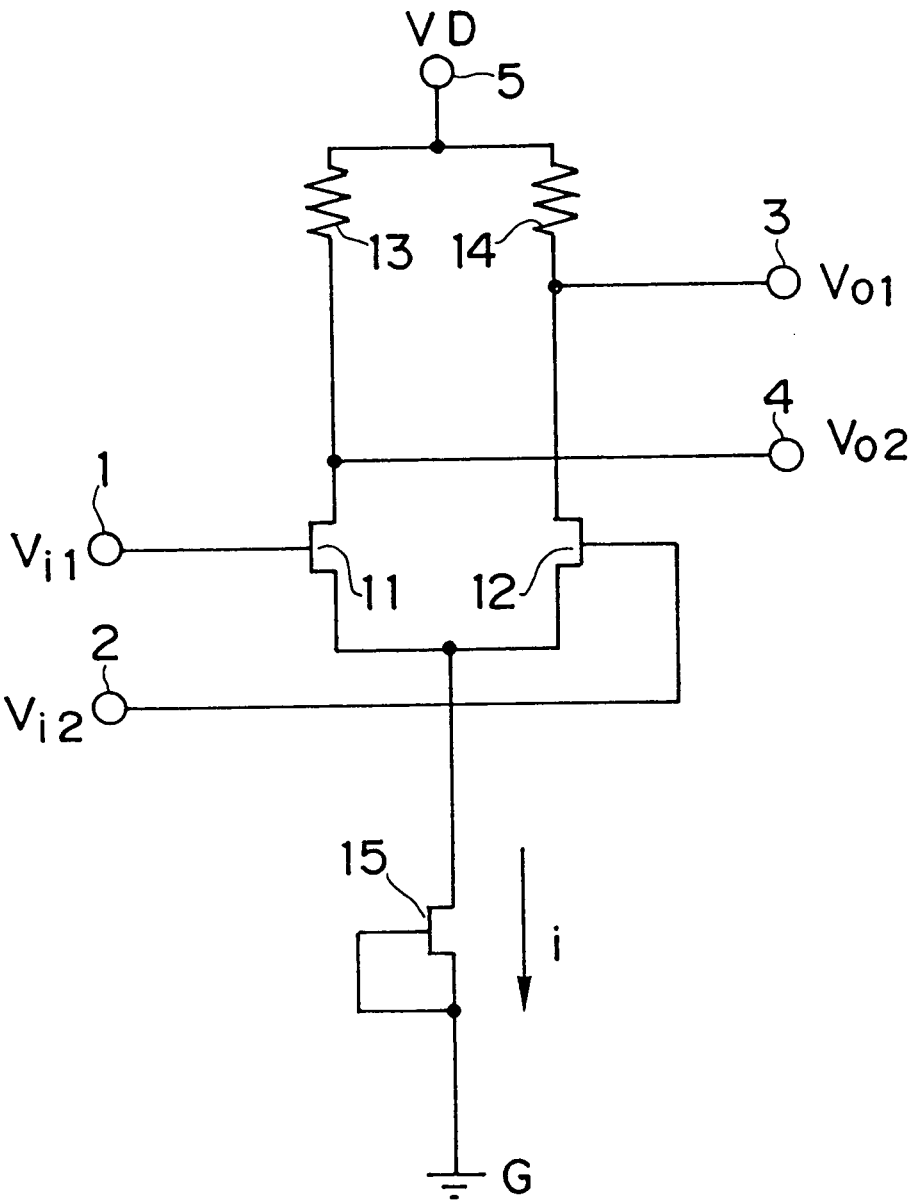
FIG. 1 PRIOR ART
FIG. 1 is a circuit diagram of a differential amplifier employing a constant current circuit available in the prior art.
Figure 2:
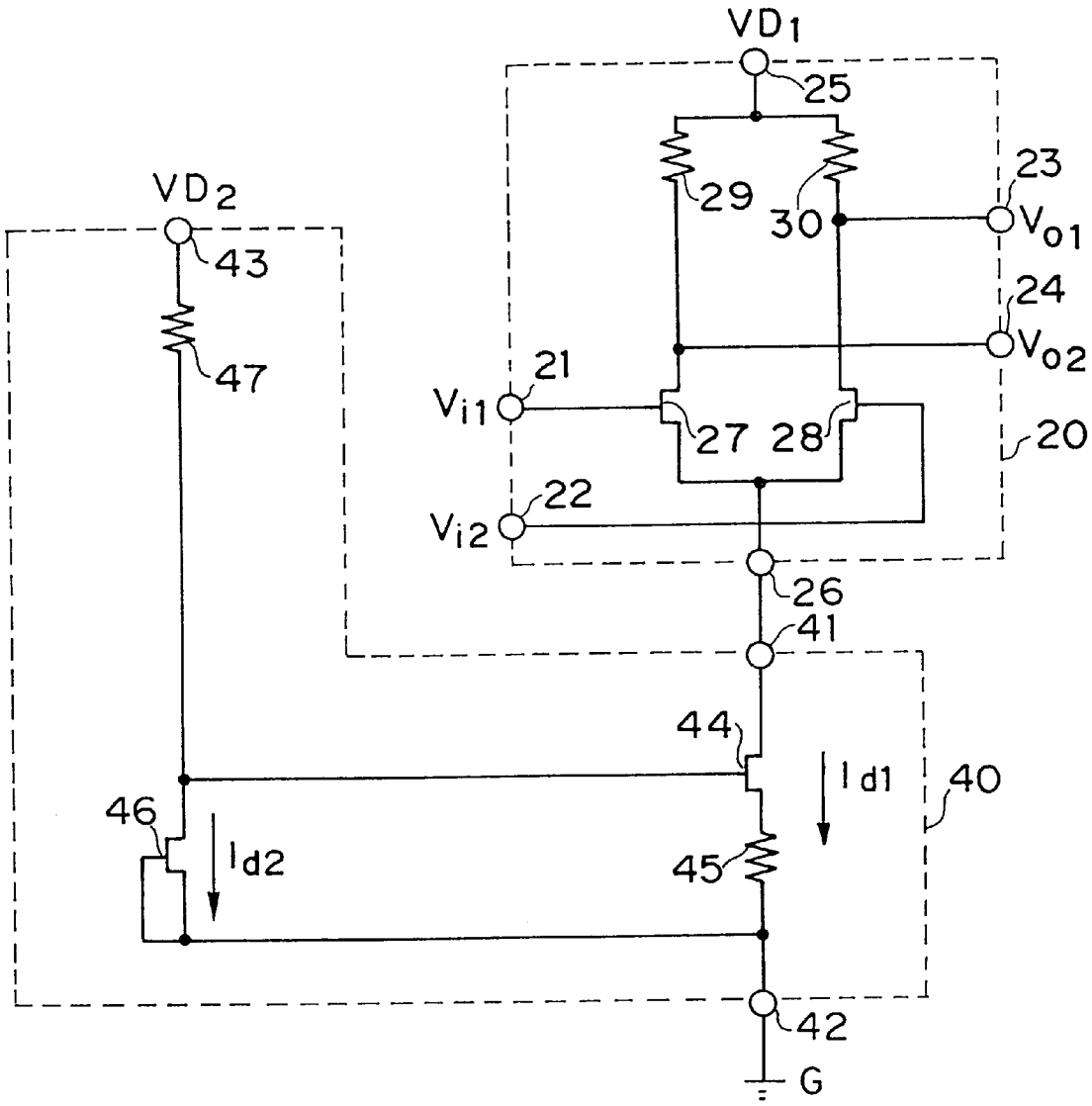
FIG. 2 is a circuit diagram of a differential amplifier employing a constant current circuit in accordance with the first embodiment of this invention.

Referring to FIG. 2, a differential amplifier is composed of a differential amplifier circuit 20 which receives input voltages $V_{i1}$ and $V_{i2}$ and outputs output bias voltages $V_{o2}$ and $V_{o1}$ corresponding to a difference of the input voltages $V_{i1}$ and $V_{i2}$, and a constant current circuit 40 of which the output current $I_{d1}$ is diverged into each branch of the differential amplifier circuit 20.

The differential amplifier circuit 20 has a positive phase signal input terminal 21 which receives an input voltage $V_{i1}$, an opposite phase signal input terminal 22 which receives an input voltage $V_{i2}$, a positive phase signal output terminal 23 which outputs an output bias voltage $V_{o1}$, an opposite phase signal output terminal 24 which outputs an output bias voltage $V_{o2}$, a power supply terminal 25 at which a power supply voltage $VD_1$, is applied and a constant current terminal 26 through which a constant current is supplied. The gates of a field effect transistor 27 and a field effect transistor 28 are respectively connected to the input terminal 21 and the input terminal 22. The drain of the field effect transistor 27 is connected to the output terminal 24 and to the power supply terminal $VD_1$ via a load resistor 29. The drain of the field effect transistor 28 is connected to the output terminal 23 and to the power supply terminal $VD_1$ via a resistor 30. The sources of the field effect transistor 27 and of the field effect transistor 28 are connected to the constant current terminal 26.

The constant current circuit 40 has an output terminal 41 which is connected to the constant current terminal 26, a first power supply terminal 42 which is connected to the ground potential in this example and a second power supply terminal 43 at which a second power supply $VD_2$ is applied in this example. The drain of a first field effect transistor 44 is connected to the output terminal 41 and the source of the first field effect transistor 44 is connected to the first power supply terminal 42 via a first resistor 45. An electric current $I_{d1}$ flows in a series circuit consisting of the first field effect transistor 44 and the first resistor 45. The gate of the first field effect transistor 44 is connected the drain of a second field effect transistor 46 of which the gate and the source are commonly connected to the first power supply terminal 42 and of which the drain is connected also to the second power supply terminal 43 via a second resistor 47.

In the differential amplifier circuit 20, the field effect transistors 27 and 28 are turned ON and OFF by application of the input voltages $V_{i1}$ and $V_{i2}$ inputted respectively at the input terminals 21 and 22. The drain current $I_{d1}$ flowing in the first field effect 44 is diverged into the sources of the field effect transistors 27 and 28, and output bias voltages $V_{o2}$ and $V_{o1}$ which are determined corresponding to a difference between the input voltages $V_{i1}$ and $V_{i2}$ are outputted from the output terminals 24 and 23.

The output bias voltages $V_{o1}$ and $V_{o2}$ which are outputted from the output terminals 23 and 24 correspond to a situation in which the drain current $I_{d1}$ of the first field effect transistor 44 is split into two equal levels of intensity. As a result, if the resistance of the load resistors 29 and 30 is supposed to be r, an equation $V_{o1}=V_{o2}=VD_1-(I_{d1}\cdot r)/2$ comes true. In addition, the maximum output amplitude of the voltage outputted at the output terminals 23 and 24 turns out to be $r\cdot I_{d1}$.

In the constant current circuit 40, if the drain current $I_{d1}$ flowing in the first field effect transistor 44 decreases due to deviation of the threshold voltage of the first field effect transistor 44 caused by dispersion or unevenness in the production process thereof or due to variation of temperature in which the constant current circuit 40 is employed, the current flowing in the second resistor 47 decreases. This increases the potential of the drain of the second field effect transistor 46 or the gate-source voltage of the first field effect transistor 44 and results in an increase of the drain current $I_{d1}$ of the first field effect transistor 44. Conversely, if the drain current $I_{d1}$ flowing in the first field effect transistor 44 increases due to the same reasons as were described above, the current flowing in the second resistor 47 increases. This decreases the potential of the drain of the second field effect transistor 46 or the gate-source voltage of the first field effect transistor 44 and results in a decrease of the drain current $I_{d1}$ flowing in the first field effect transistor 44.

In this manner, deviation of the output current is successfully compensated in the constant current circuit 40.

Generally speaking, the drain current $I_d$ of a field effect transistor can be described as:

$$I_d=gm\ (V_g-V_s-V_t)+gd\ (V_d-V_s)$$

wherein:

gm is the transmission conductance of the field effect transistor, gd is the drain conductance of the field effect transistor, $V_t$ is the threshold voltage of the field effect transistor, $V_d$ is the drain voltage applied to the field effect transistor, $V_g$ is the gate voltage applied to the field effect transistor, and $V_S$ is the source voltage applied to the field effect transistor.

Accordingly, the drain current $I_{d1}$, flowing in the first field effect transistor 44, the drain current $I_{d2}$ flowing in the second field effect transistor 46 and the gate voltage $V_g$ of the first field effect transistor 44 are respectively described as:

$$I_{d1}=gm\cdot W_1\cdot(V_g-r_1\cdot I_{d1}-V_t)+gd\cdot W_1\cdot(V_{d1}-r_1\cdot I_{d1}) \quad (1)$$

$$I_{d2}=gm\cdot W_2\cdot(-V_t)+gd\cdot W_1\cdot(VD_2-r_2\cdot I_{d2}) \quad (2)$$

$$V_g=VD_2-r_2\cdot I_{d2} \quad (3)$$

Converting these equations, $$I_{d1}=\frac{gm\cdot W_1\cdot(Vg-Vt)+gd\cdot W_1\cdot V_{d1}}{1+r_1\cdot W_1\cdot(gm+gd)} \quad (4)$$

$$I_{d2}=\frac{-gm\cdot W_2\cdot Vt+gd\cdot W_2\cdot VD_2}{1+gd\cdot W_2\cdot r_2} \quad (5)$$

Combining the equations (3) and (5):

$$V_g=\frac{gm\cdot W_2\cdot r2\cdot Vt+VD_2}{1+gd\cdot W_2\cdot r_2} \quad (6)$$

Combining the equations (4) and (6):

$$I_{d1}=\frac{gm\cdot W_1\cdot(gm\cdot W2\cdot r2-gd\cdot W_2\cdot r2-1)\cdot Vt}{(1+gd\cdot W_2\cdot r_2)\cdot(1+gm\cdot W_1\cdot r_1+gd\cdot W_1\cdot r_1)}+\frac{gd\cdot W_1\cdot(1+gd\cdot W_2\cdot r_2)\cdot Vd_1+gm\cdot W_1\cdot VD_2}{(1+gd\cdot W_2\cdot r_2)\cdot(1+gm\cdot W_1\cdot r_1+gd\cdot W_1\cdot r_1)} \quad (7)$$

Differentiating the equation (7):

$$\frac{d\,I_{d1}}{d\,Vt}=\frac{gm\cdot W_1\cdot(gm\cdot W_2\cdot r_2-gd\cdot W_2\cdot r_2-1)}{(1+gd\cdot W_2\cdot r_2)\cdot(1+gm\cdot W_1\cdot r_1+gd\cdot W_1\cdot r_1)} \quad (8)$$

This means that $I_{d1}$ is independent from $V_t$ under a condition reading $dI_{d1}/dV_t=0$ or $r_2=1/(W_2\cdot(gm-gd))$.

In addition, the second power supply $VD_2$ is described as:

$$VD_2=Vg+r_2\cdot Id_2$$

Since $V_g$ represents also the drain-source voltage of the second field effect transistor 46, a condition reading (Minimum saturation voltage of the second field effect transistor 46$\leqq V_g \leqq$(Minimum drain-source breakdown voltage of the second field effect transistor 46) must be satisfied. If the resistance $r_1$ of the first resistor 45 is selected to satisfy a condition reading ($r_1\cdot I_{d1}=V_g$), the amount of the drain current $I_{d1}$ flowing in the first field effect transistor 44 turns out to be in the same level as the drain current of the constant current circuit available in the prior art.

The foregoing description has clarified that a constant current circuit 40 which can realize the following advantages has been successfully provided by the first embodiment of this invention.

1. If the drain current $I_{d1}$ flowing in the first field effect transistor 44 decreases due to deviation of the threshold voltage of the first field effect transistor 44 caused by dispersion or unevenness in the production process thereof or due to variation of temperature in which the constant current circuit 44 is employed, the gate-source voltage of the first field effect transistor 44 increases to increase the drain current $I_{d1}$ and if the drain current $I_{d1}$ flowing in the first field effect transistor 44 increases due to the same reasons as are described above, the gate-source voltage of the first field effect transistor 44 decreases to decrease the drain current $I_{d1}$, resultantly stabilizing the drain current $I_{d1}$ flowing in the constant current circuit 40 and restricting deviation of the output bias voltage from a designated amount, in an allowable extent.

2. The maximum output amplitude of a differential amplifier circuit is stabilized due to the same reasons as are described above.

SECOND EMBODIMENT

Figure 3:
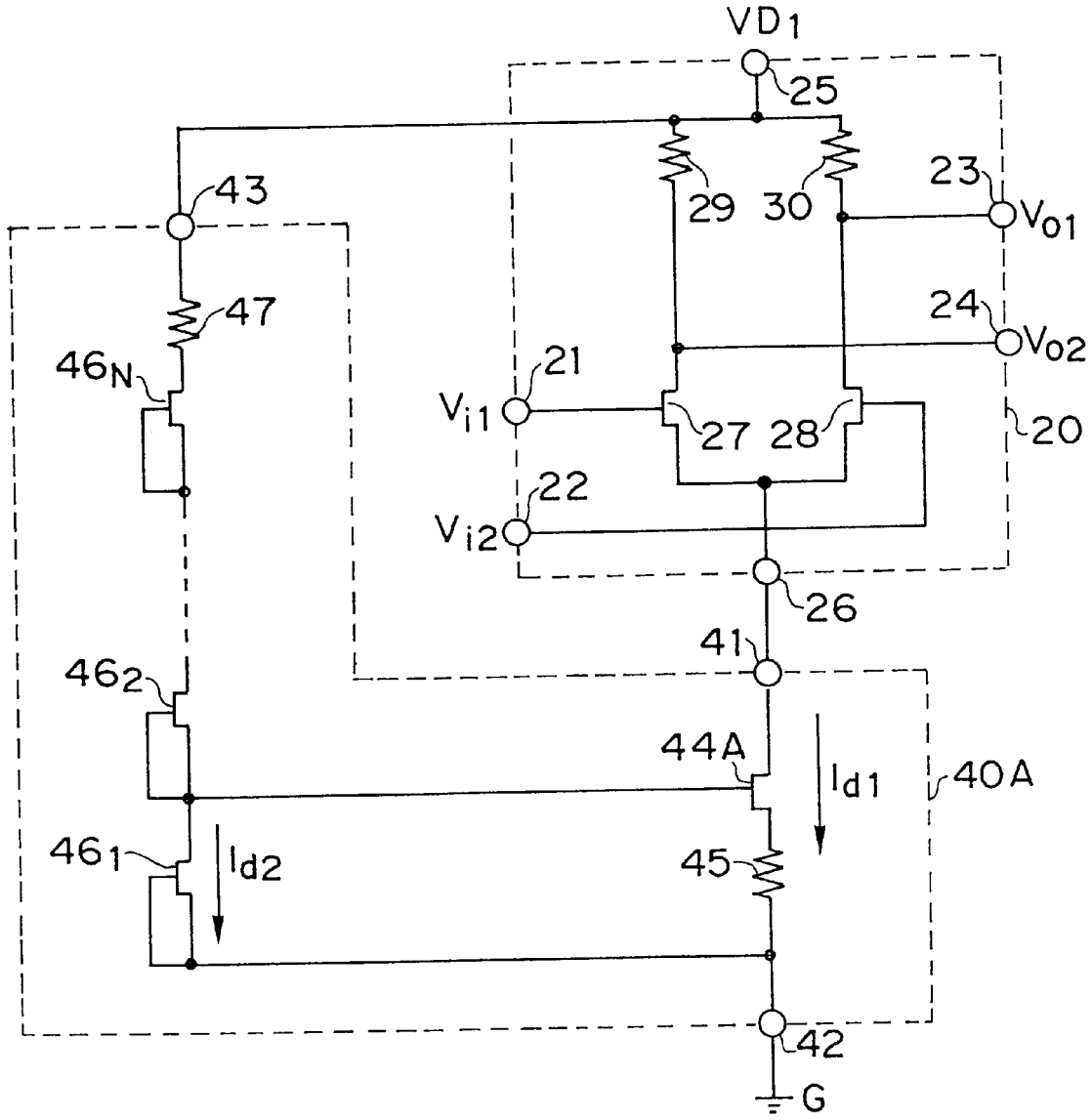
FIG. 3 is a circuit diagram of a differential amplifier employing a constant current power supply circuit in accordance with the second embodiment of this invention.

Referring to FIG. 3, a differential amplifier is composed of a differential amplifier circuit 20 identical to that which is one of the components composing the differential amplifier described in the first embodiment of this invention and a constant current circuit 40A in accordance with the second embodiment of this invention.

The constant current circuit 40A has an output terminal 41 which is connected to the constant current terminal 26, a first power supply terminal 42 which is connected the ground potential in this example and a second power supply terminal 43 at which a first power supply $VD_1$, which is the power supply of the differential amplifier circuit 20 as well, is applied in this example. The drain of a first field effect transistor 44A is connected to the output terminal 41 and the source of the first field effect transistor 44A is connected to the first power supply terminal 42 via a first resistor 45. An electric current $I_{d1}$ flows in a series circuit consisting of the first field effect transistor 44A and the first resistor 45. The gate of the first field effect transistor 44A is connected to the drain of the first one $\mathbf{46}_1$ of field effect transistors $\mathbf{46}_1$ through $\mathbf{46}_N$ composing a series circuit of N pieces of field effect transistors or the one $\mathbf{46}_1$ nearest to the ground potential of field effect transistors $\mathbf{46}_1$ through $\mathbf{46}_N$ composing a series circuit of N pieces of field effect transistors. The gate and the source of each of the field effect transistor $\mathbf{46}_1$ through $\mathbf{46}_N$ are connected to each other. The series circuit composing N pieces of the field effect transistors $\mathbf{46}_1$ through $\mathbf{46}_N$ intervenes between the first power supply terminal 42 and one end of the second resistor 47 of which the other end is connected to the second power supply terminal 43 which is connected to the power supply terminal 25 of the differential amplifier circuit 20 in this embodiment.

In the differential amplifier circuit 20, the field effect transistors 27 and 28 are turned ON and OFF by application of the input voltages $V_{i1}$ and $V_{i2}$ inputted respectively at the input terminals 21 and 22. The drain current $I_{d1}$ flowing in the field effect transistor 44A is diverged into the sources of the field effect transistors 27 and 28, and output bias voltages $V_{o2}$ and $V_{o1}$ which are determined corresponding to a difference between the input voltages $V_{i1}$ and $V_{i2}$ are outputted from the output terminals 24 and 23.

The output bias voltages $V_{o1}$ and $V_{o2}$ which are outputted from the output terminals 23 and 24 correspond to a situation in which the drain current $I_{d1}$ of the first field effect transistor 44 is split into two equal levels of intensity. As a result, if the resistance of the load resistors 29 and 30 is supposed to be r, an equation $V_{o1}=V_{o2}=VD_1-(I_{d1}\cdot r)/2$ comes true. In addition, the maximum output amplitude of the voltage outputted at the output terminals 23 and 24 turns out to be $r\cdot I_{d1}$.

In the constant current circuit 40A, if the drain current $I_{d1}$ flowing in the first field effect transistor 44A decreases due to deviation of the threshold voltage of the first field effect transistor 44A caused by dispersion or unevenness in the production process thereof or due to variation of temperature in which the constant current circuit 40A is employed, the current flowing in the second resistor 47 decreases. This increases the potential of the drain of the field effect transistor $\mathbf{46}_1$ or the gate-source voltage of the first field effect transistor 44A by 1/N of the decrement of the potential drop in the second resistor 47 and results in an increase of the drain current $I_{d1}$ of the first field effect transistor 44A. Conversely, if the drain current $I_{d1}$ flowing in the first field effect transistor 44A increases due to the same reasons as were described above, the current flowing in the second resistor 47 increases. This decreases the potential of the drain of the field effect transistor $\mathbf{46}_1$ or the gate-source voltage of the first field effect transistor 44A by 1/N of the increment of the potential drop in the second resistor 47 and results in a decrease of the drain current $I_{d1}$ flowing in the field effect transistor 44A.

In this manner, deviation of the output current is successfully compensated in the constant current circuit 40A.

In a similar way to the corresponding description in the first embodiment, the drain current $I_{d1}$ flowing in the first field effect transistor 44A, the current $I_{d2}$ flowing in the second field effect transistor $\mathbf{46}_1$, and the gate-source voltage of the first field effect transistor 44A are respectively described as:

$$I_{d1}=gm\cdot W_1\cdot(V_g-r_1\cdot I_{d1}-V_t)+gd\cdot W_1\cdot(V_{d1}-r_1\cdot I_{d1}) \tag{9}$$

$$I_{d2}=gm\cdot W_2\cdot(-V_t)+gd\cdot W_1\cdot(VD_1-r_2\cdot I_{d2})/N \tag{10}$$

$$V_g=(VD_1-r_2\cdot I_{d2})/N \tag{11}$$

wherein:

$Wg_1$ is the gate width of the first field effect transistor 44A, $Wg_2$ is the gate width of each of the field effect transistors $\mathbf{46}_1$ through $\mathbf{46}_N$ composing the series circuit of field effect transistors, gm is the transfer conductance per unit gate width of the first field effect transistor 44A and each of the field effect transistors $\mathbf{46}_1$ through $\mathbf{46}_N$ composing the series circuit of field effect transistors, gd is the drain conductance per unit gate width of the first field effect transistor 44A and each of the field effect transistors $\mathbf{46}_1$ through $\mathbf{46}_N$ composing the series circuit of field effect transistors, $V_t$ is the threshold voltage of the first field effect transistor 44A and each of the field effect transistors $\mathbf{46}_1$ through $\mathbf{46}_N$ composing the series circuit of field effect transistors, $r_1$ is the resistance of the first resistor 45, $r_2$ is the resistance of the second resistor 47, and $V_{d1}$ is the voltage applied to the terminal 41.

Converting these equations, $$I_{d1}=\frac{gm\cdot W_1\cdot(Vg-Vt)+gd\cdot W_1\cdot V_{d1}}{1+r_1\cdot W_1\cdot(gm+gd)} \tag{12}$$

$$I_{d2}=\frac{-n\cdot gm\cdot W_2\cdot Vt+gd\cdot W_2\cdot VD_1}{n+gd\cdot W_2\cdot r_2} \tag{13}$$

Combining the equations (11) and (13):

$$V_g=\frac{gm\cdot W_2\cdot r2\cdot Vt+VD_1}{n+gd\cdot W_2\cdot r_2} \tag{14}$$

Combining the equations (12) and (14):

$$I_{d1} = \frac{gm \cdot W_1 \cdot (gm \cdot W2 \cdot r2 - gd \cdot W_2 \cdot r2 - n) \cdot Vt}{(n + gd \cdot W_2 \cdot r_2) \cdot (1 + gm \cdot W_1 \cdot r_1 + gd \cdot W_1 \cdot r_1)} + \frac{gd \cdot W_1 \cdot (n + gd \cdot W_2 \cdot r_2) \cdot Vd_1 + gm \cdot W_1 \cdot VD_1}{(n + gd \cdot W_2 \cdot r_2) \cdot (1 + gm \cdot W_1 \cdot r_1 + gd \cdot W_1 \cdot r_1)} \quad (15)$$

Differentiating the equation (15):

$$\frac{d\,I_{d1}}{d\,Vt} = \frac{gm \cdot W_1 \cdot (gm \cdot W2 \cdot r2 - gd \cdot W_2 \cdot r2 - n)}{(n + gd \cdot W_2 \cdot r_2) \cdot (1 + gm \cdot W_1 \cdot r_1 + gd \cdot W_1 \cdot r_1)} \quad (16)$$

This means that $I_{d1}$ is independent from $V_t$ under a condition reading $dI_{d1}/dV_t$=o or $r_2$=N/($W_2$·(gm−gd)).

In addition, since the drain-source voltage is same for all the field effect transistors 46$_1$ through 46$_n$, the power supply $VD_1$ is described as:

$$VD_1 = NVg + r_2 \cdot I_{d2}$$

Since Vg represents the drain-source voltage of the second field effect transistor 46$_1$, a condition reading (Minimum saturation voltage of the second field effect transistor 46$_1$≦Vg≦(Minimum drain-source breakdown voltage of the second field effect transistor 46$_1$) must be satisfied. If the resistance of the first resistor $r_1$ is selected to satisfy a condition reading ($r_1 \cdot I_{d1}$=Vg), the amount of the drain current $I_{d1}$ flowing in the first field effect transistor 44A turns out to be in the same level as the drain current of the constant current circuit available in the prior art.

The foregoing description has clarified that a constant current circuit 40A which can realize the following advantage in addition to the advantages of the first embodiment has been successfully provided by the second embodiment of this invention. The additional advantage is: A single power supply can be employed for a differential amplifier circuit comprising a differential amplifier circuit 20 and a constant current circuit 40A, provided the gate voltage Vg is selected for the first field effect transistor 44A to satisfy the condition reading (Minimum saturation voltage of the second field effect transistor 46$_1$≦Vg≦(Minimum drain-source break down voltage of the second field effect transistor 46$_1$) and the number of the N is selected to make the voltage to be applied to the power supply terminal 43 identical to the power supply $VD_1$ of the differential amplifier circuit 20.

MODIFICATION

Various modifications can be stemmed from this invention, as are tabulated below.

1. The gate of the first field effect transistor 44A of the constant current circuit of the second embodiment of this invention can be connected any of the drains of the field effect transistors 46$_1$, through 46*m* (m is an arbitrary number selected from 2 through N), provided the resistance $r_2$ of the second resistor 47 is selected to be:

$$r_2 = \frac{N}{m \cdot W_2 \cdot (gm - gd)}$$

2. The equation showing the resistance $r_2$ of the second resistor 47 of the constant current circuit of the first or second embodiment of this invention is not imperative. In other words, the resistance $r_2$ of the second resistor 47 of the constant current circuit of the first or second embodiment of this invention can be any amount, despite the value shown by the foregoing equation is the optimum Value.

The foregoing description has clarified that a constant current circuit of which the output current is stable, even in the case where the threshold voltage of field effect transistors employed therein, deviates from the designed value due to dispersion or unevenness in the production process thereof and/or in the case where the temperature under which the constant current circuit is employed varies, are successfully provided by this invention.

Although this invention has been described with reference to specific embodiments, in which the constant current circuits are employed for a differential amplifier, this description is not meant to be construed in a limiting sense. In other words, the philosophy of this invention may be expanded to a circuit employing one or more bipolar transistors and other components. As a result, various modifications of the disclosed embodiments as well as other embodiments of this invention, will be apparent to persons skilled in the art upon reference to the description of this invention. It is therefore contemplated that the appended claims will cover any such modifications or embodiments as fall within the true scope of this invention.

What is claimed is:

1. A constant current circuit comprising:

a first field effect transistor having a drain connected to a first power supply via a first resistor, and a second field effect transistor having a drain connected to a gate of said first field effect transistor and to a second power supply via a second resistor and having a source and a gate connected to said first power supply, wherein the resistance $r_2$ of the second resistor satisfies a first condition, $r_2$=1/($W_2$·(gm−gd)), in which $W_2$ is the gate width of said second field effect transistor, gm is the transmission conductance per unit gate width of said first and second field effect transistors, and gd is the drain conductance per unit gate width of said first and second field effect transistors, the gate voltage Vg of said first field effect transistor satisfies a second condition, minimum saturation voltage of said second field effect transistor≦Vg≦minimum drain-source breakdown voltage of said second field effect transistor, and the resistance $r_1$, of the first resistor satisfies a third condition, $r_1 \cdot I_{d1}$=Vg, in which $I_{d1}$ is the drain current flowing in said first field effect transistor.

2. A constant current circuit comprising:

a first field effect transistor having a drain connected to an output terminal and having a source connected to a first power supply terminal via a first resistor, a plural number N of field effect transistors, desicnatable by respective ordinal numbers 1 through N, and of which each has a gate, a source connected to the gate, and a drain, all of the plural number N of field effect transistors being connected in series to one another to form a series circuit of N field effect transistors, a drain of a field effect transistor located at one end of said series circuit being connected to a second power supply terminal via a second resistor, a drain of one of the N field effect transistors forming said series circuit, being connected to a gate of said first field effect transistor, said one field effect transistor having an ordinal number m selected arbitrarily from 2 through N, and an end of said series circuit opposite to said one end of said series circuit being connected to said first power supply terminal, wherein the resistance $r_2$ of the second resistor satisfies a first condition, $r_2=1/(W_2\cdot(gm-gd))$, in which $W_2$ is the gate width of each of said N field effect transistors, gm is the transmission conductance per unit gate width of each of said N field effect transistors, and gd is the drain conductance per unit gate width of said first field effect transistor and of each of said N field effect transistors, the gate voltage Vg of said first field effect transistor satisfies a second condition, minimum saturation voltages of said plurality of field effect transistors each of whose ordinal number is 1 through $m \leqq Vg \leqq$ sum of minimum drain-source breakdown voltages of those of the N field effect transistors whose ordinal numbers are in the range 1 through m, and the resistance $r_1$ of the first resistor satisfies a third condition, $r_1\cdot I_{d1}=Vg$, in which $I_{d1}$ is the drain current flowing in said first field effect transistor.

3. A constant current circuit in accordance with claim 2, wherein the length of said series circuit as represented by the number N is selected to make potential of said second power supply identical to potential of power supply of an external circuit for which said constant current circuit is employed.

* * * * *